US005511753A

United States Patent [19]

Lage

[11] Patent Number: 5,511,753

[45] Date of Patent: Apr. 30, 1996

[54] PAINT CAN HOLDER

[76] Inventor: Randy R. Lage, 1867 Slippery Rock Rd., Naperville, Ill. 60565

[21] Appl. No.: 350,812

[22] Filed: Dec. 7, 1994

[51] Int. Cl.[6] ..... E04G 3/08

[52] U.S. Cl. ..... 248/238; 220/737

[58] Field of Search ..... 248/238, 210, 248/211; 220/737, 740; 182/129

[56] References Cited

U.S. PATENT DOCUMENTS

| | | | |
|---|---|---|---|
| 3,103,334 | 9/1963 | Thoms | 248/238 |
| 4,534,528 | 8/1985 | Rousseau | 248/210 |
| 4,560,127 | 12/1985 | Ippolito | 248/210 |
| 4,874,147 | 10/1989 | Ory et al. | 248/210 |
| 4,964,527 | 10/1990 | Martin . | |
| 5,025,581 | 10/1991 | Christ et al. | 248/211 X |
| 5,305,977 | 4/1994 | Roth | 248/210 |
| 5,342,008 | 8/1994 | Kay | 248/210 X |

OTHER PUBLICATIONS

"TIP 'n DIP" product wrapper.

*Primary Examiner*—Ramon O. Ramirez
*Attorney, Agent, or Firm*—Gerlach & O'Brien

[57] ABSTRACT

A paint can holder for suspending a paint can with the mouth of the can open to enable painting directly from the can, such can having a sealing rim around its mouth, includes a paint can support mountable on a ladder, the support including a collar portion to be seated on the sealing rim of the can with the mouth of the can open and covering the rim while seated thereon, the collar portion defining an opening substantially registering with the inner periphery of the paint can rim when seated thereon, a sealing ring depending from the collar portion adjacent to the opening defined thereby, for being received telescopically within the paint can rim with the mouth of the can open when the collar portion is seated on the rim, in a friction fit between the sealing ring and the inner periphery of the paint can rim, to prevent flow of paint therebetween, and structure for detachably connecting the paint can to the support for suspending the paint can from the support with the collar portion seated on the paint can rim and the sealing ring received within the rim in a friction fit.

10 Claims, 2 Drawing Sheets

PAINT CAN HOLDER

This invention relates to a device serving to hold a paint can for painting while the painter stands on a ladder, without spilling the paint. In particular, the invention relates to such a device that enables the painter to paint with a brush directly from an open can of paint.

The problems of painting from an open can of paint are well known, especially as concerns spilling paint from the can. Paint cans commonly are suspended from ladders or are hand-held, or may be supported on a pail shelf or other surface. The cans frequently are susceptible to spillage caused by tilting, overturning, or movement causing the paint to splash. Nevertheless, the market apparently is not supplying adequate devices or equipment that will avoid these mishaps.

SUMMARY OF THE INVENTION

An important object of the invention is to provide a holder for suspending a paint can with the mouth of the can open to enable painting directly from the can, in particular, a holder mountable on a ladder for suspending the paint can at a desired elevation.

Another object is to provide such a holder that is easily and conveniently connected or attached to a paint can, for use on a ladder, or in another disposition, and then, suspending the paint can so that it is conveniently accessible to the painter.

An additional object is to provide such a paint can holder that may be attached to a stepladder while holding the paint can level and without spilling paint, and, particularly, that may be attached to the top piece or top of the ladder.

A particular object is to provide such a paint can holder that prevents paint from reaching the groove in the sealing rim conventionally provided around the mouth of a paint can.

In its preferred embodiments, the invention provides a paint can holder for suspending a paint can with the mouth of the can open to enable painting directly from the can, such can having a sealing rim around its mouth, which comprises a paint can support mountable on a ladder, means for mounting the support on a ladder, such support including a collar portion adapted for seating on the sealing rim with the mouth of the can open and covering the rim while seated thereon, the collar portion defining an opening substantially registering with the inner periphery of the paint can rim when seated thereon, a sealing ring depending from the collar portion adjacent to the opening defined thereby and received telescopically within the paint can rim with the mouth of the can open when the collar portion is seated on the rim, in a friction fit between the sealing ring and the inner periphery of the paint can rim, to prevent flow of paint therebetween, and means for detachably connecting the paint can to the support for suspending the paint can from the support with the collar portion seated on the rim and the sealing rim received within the rim in the aforesaid friction fit.

In additionally preferred embodiments, the means for connecting the paint can to the support comprises means for clamping the paint can rim to the support.

In further preferred embodiments, the means for mounting the support on a ladder comprises means on the support for interlocking engagement with complementary means on a ladder, the means on the support and the means on the ladder are adapted for sliding translational movement relative to each other, for engaging and disengaging such means and loading and unloading the paint can holder by transverse or horizontal movement from and to a position to the side of the ladder.

The foregoing and other objects, advantages, features and functions of the invention will be apparent from the description which follows and upon reference to the drawings forming a part hereof.

BRIEF DESCRIPTION OF THE DRAWINGS

The drawings illustrate a preferred embodiment of the invention, without limitation thereto. In the drawings, like elements are identified by like reference characters in each of the views, and.

DESCRIPTION OF THE PREFERRED EMBODIMENT

Figure 1:
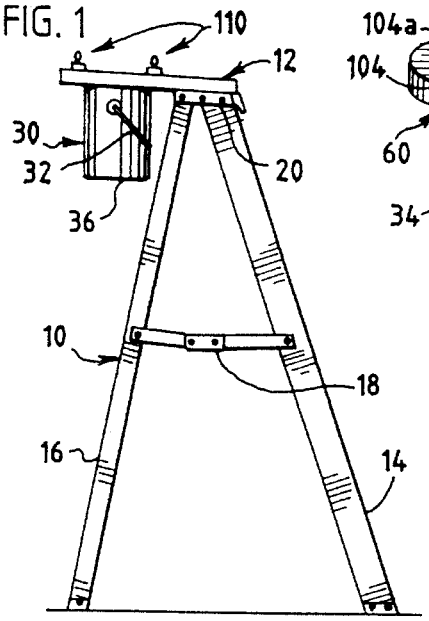
FIG. 1 is a side elevational view of a stepladder having a paint can holder mounted thereon, in accordance with the invention.

Referring to FIG. 1 of the drawings, a conventional stepladder 10 is illustrated, with a paint can holder 12 mounted thereon, in a preferred assembly of a ladder and a holder in accordance with the invention.

Figure 4:
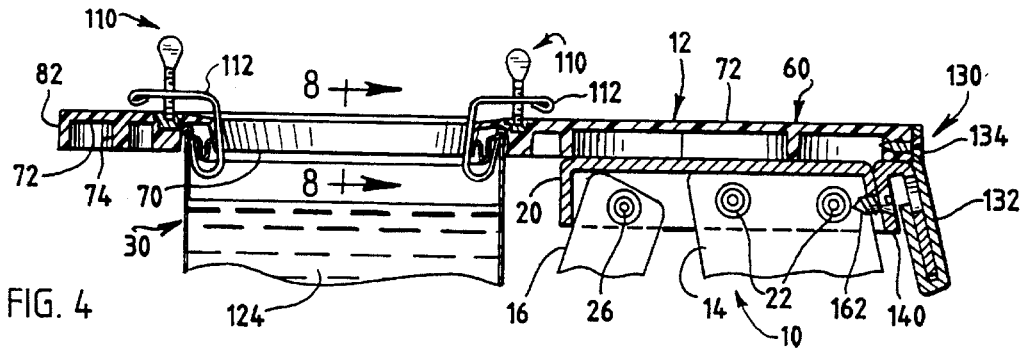
FIG. 4 is a longitudinal vertical sectional view of the structure shown in FIG. 3, taken substantially on line 4—4 thereof and on substantially the same scale, with the addition thereto of a substantially full paint can detachably connected to the support by clamping means, parts of the structure being shown fragmentarily.

The stepladder 10 includes a pair of front legs 14, that are in spaced parallel relation and are joined together in a conventional manner by transversely extending steps (not shown) ascending the ladder. A spaced parallel pair of back legs 16 having braces (not shown) extending therebetween, is joined to the pair of front legs 14 by a pair of spreaders 18 respectively joining together the front and back legs 14 and 16 on the opposite sides of the stepladder. As seen in FIG. 4, the front legs 14 are immovably fixed to a horizontal transverse top piece, member, or crossbar 20 surmounting the legs, by fastening means such as rivets 22. The rivets extend through side walls 24 on opposite sides of the top piece 20, and through the front legs 14.

The back legs 16 are pivotally secured to the side walls 24, by suitable pivot fasteners 26. The back legs 16 may be closed to positions closely adjacent to the front legs 14 by pivoting the back legs while causing the spreaders 18 to fold, when the ladder 10 is to be put away or moved.

While the materials of construction and the details of the structure of a stepladder are not a matter of concern, the illustrative ladder 10 is constructed of legs 14 and 16 made of pressed and molded "Fiberglas"-resin or plastic material. The top piece is made of strong, relatively light metal, such as an aluminum alloy. The top piece 20 is not intended for use as a step. For this and other reasons, the paint can holder 12 is mounted thereon.

The paint can holder 12 of the invention is particularly designed for use with the standard paint can used in large quantities both by professionals and by householders. Referring to FIGS. 1, 2, 4, 6, and 8, a can 30 of the popular one-gallon size, having a bail 32, is illustrated with the holder 12 of the invention. The can 30 is round, having a cylindrical tubular container body 34 and a circular base 36. None of the views shows the can lid, which is conventional, inasmuch as it is not in use when the can is mounted to the holder 12.

In numerous instances when painting, it is desirable to paint from the original container, with the can open, i.e., with its lid removed, rather than pouring the paint from the can into another reservoir. It is also desirable to paint with a relatively broad brush, which when employing the present invention may be a three and one-half or four-inch brush. Such a brush is used frequently for "cutting in" at wall intersections and corners, while the remaining broad expanses of wall surface are painted with rollers.

Figure 6:
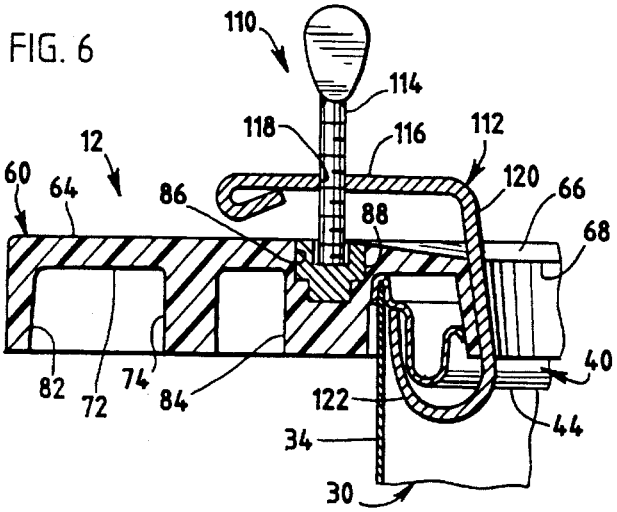
FIG. 6 is a further enlarged fragmentary vertical sectional view of the support, paint can, and clamping means, taken substantially on line 6—6 of FIG. 2.
Figure 8:
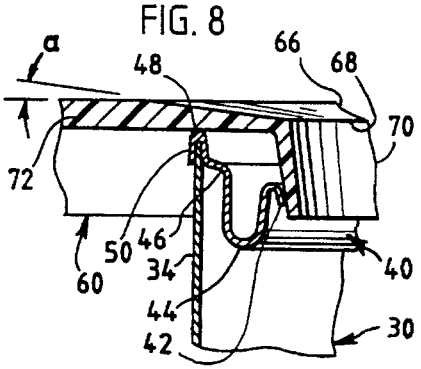
FIG. 8 is a fragmentary vertical sectional view of the support and the paint can, similar to FIG. 6 but taken substantially on line 8—8 of FIG. 4.

Referring to FIGS. 6 and 8, the body 34 of the paint can 30 is surmounted by a circular or annular sealing rim 40. In the illustrative structure, the rim 40 is sinuous or serpentine in cross section, and it cooperates with a complementary rim of a generally planar lid (not shown) to close and seal the paint can 30, in a well known manner.

The rim 40 includes an innermost circumferential flange portion 42, which surrounds and defines the mouth of the paint can. The flange portion 42 is succeeded, in the radially outwardly direction, by a generally U-shaped grooved portion or channel 44, and a shoulder 46, all of the foregoing being spaced downwardly and inwardly, or recessed from the outer edge 48 of the can 30. Following the shoulder 46, an inverted U-shaped outermost fastening portion 50 of the rim 40 is firmly secured to the can 30 around the outer edge 48 on the can body 34, to prevent any escape of paint between the rim 40 and the edge 48.

The annular grooved portion 44 receives a complementary annular projecting portion (not shown) of the can lid. Inasmuch as a can of paint may be reused a number of times, it is desirable to keep the grooved portion 44 free of paint, and also to prevent paint in the rim 40, including the grooved portion 44, from flowing over the top of the fastening portion 50 and onto the outside of the can body 34. The paint can holder 12 of the invention performs this function.

Available options for painting directly from the paint can 30 include the technique frequently used by professionals of holding the can in one arm while holding a brush in the other arm, especially for "cutting in." This technique can be tiring and, consequently, most frequently is used with a can partly emptied of its contents. The technique may be less desirable when performed by the average homeowner, can be messy, and may lead to dropping the can and spilling its contents. A sizable quantity of paint spilled on the floor can penetrate a dropcloth. Another technique, used when working with a ladder, involves using a bucket hook on the bail 32, hooked to a ladder rung. The paint can contents then may be less accessible then is desirable. Alternatively, the paint can may be set down on the pail shelf of a stepladder, or on another surface, for painting from the can. With the can not anchored, it may be knocked over, and, in some cases, may require more body movement as the painter replenishes paint on the paintbrush as painting continues.

The paint can holder 12, in comparison, is especially valuable in its presentation of a can that is filled with paint to any desired or convenient level, in the can, that is readily accessible, so as to require a relatively small range of motions during painting, and, especially, that is secure against spillage. It is desirably mounted on stepladders of the common five foot and six foot height size, may also be used at intermediate levels on shorter ladders, and may even be used on the floor or ground, or another supporting surface. While the latter disposition of the paint can holder and the can held thereby are useful and have advantages, the free-standing holder and can assembly may be knocked over. Thus, the latter manner of use is to be regarded more as an expedient.

Figure 2:
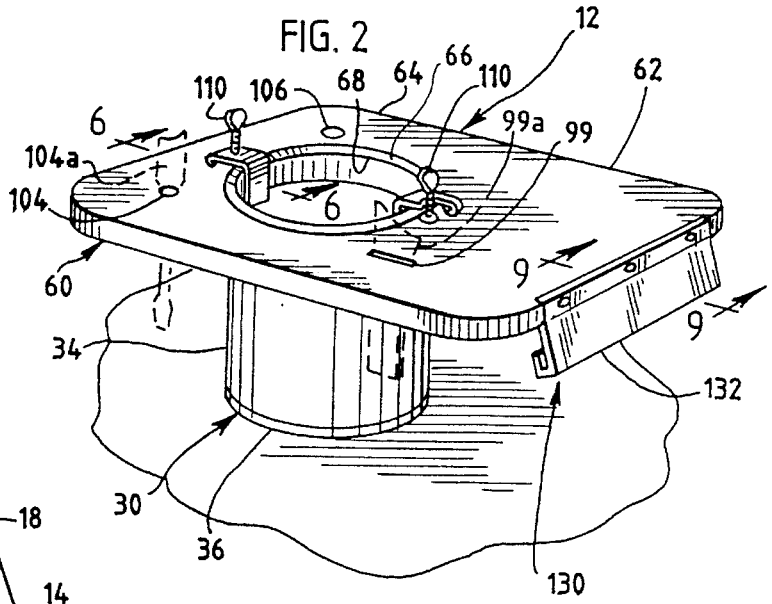
FIG. 2 is an enlarged front and side perspective view of the paint can holder of the invention.
Figure 3:
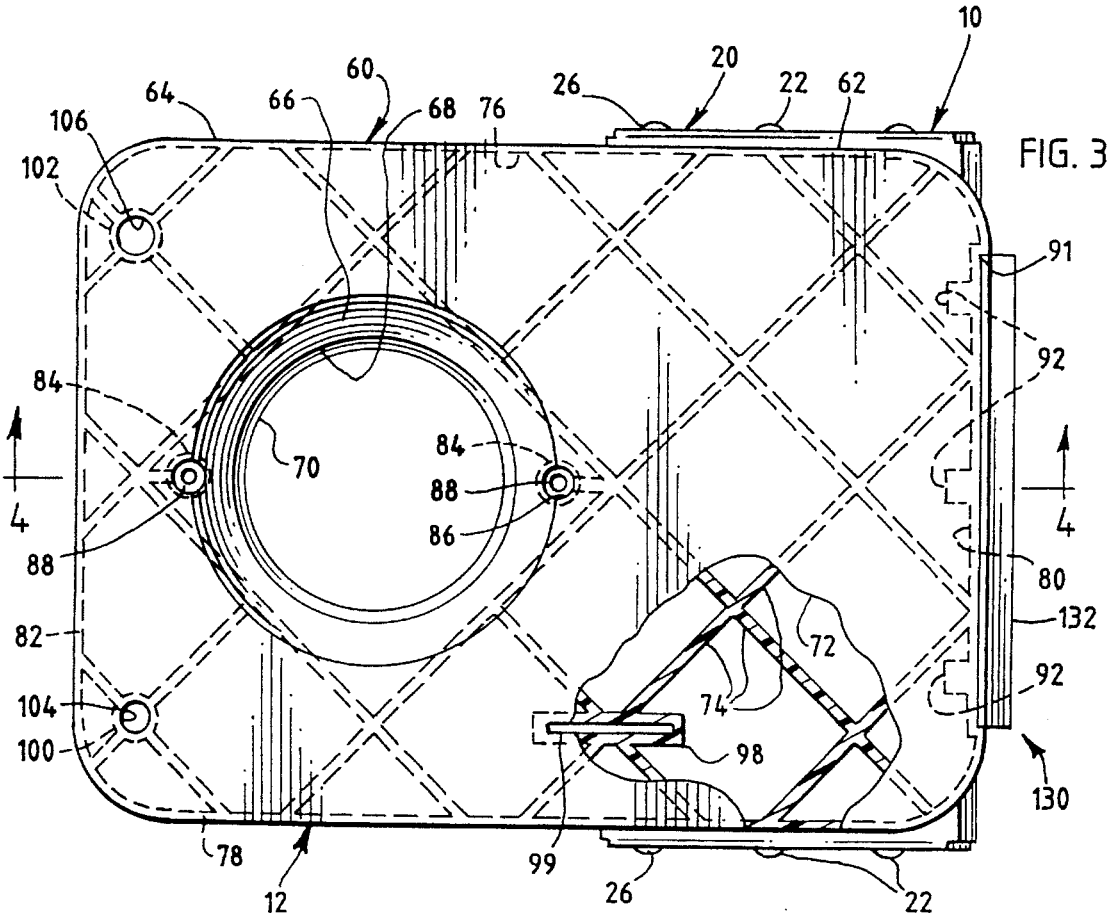
FIG. 3 is a further enlarged top plan view of a paint can support of the holder, and means for mounting the support on a ladder, shown mounted on the top piece of a stepladder and having a portion broken away to reveal structure of the support disposed beneath the upper surface thereof.

Referring especially to FIGS. 2–4, the paint can holder 12 is constructed of a support in the form of a relatively flat oblong shelf or board 60 having respective front and rear end portions 62 and 64. The shelf 60 includes a circular collar or ring portion 66 that defines a circular opening 68 centered between the sides of the shelf 60 in the rear end portion 64 thereof. The collar portion 66 tapers radially inwardly, and, in the position in which the holder normally is used, downwardly, from the outer margin to the inner margin of the collar portion, as illustrated in FIG. 8. The taper or the incline angle a from the flat, normally horizontal, surface of the shelf 60 is but a small angle, sufficient to enable paint on the surface of the collar portion 66 to run down or flow to the opening 68, for eventual return to the paint can 30.

As seen most clearly in FIGS. 6 and 8, the collar portion 66 is constructed and arranged or adapted for seating on the sealing ring 40 when the holder 12 is assembled with the can 30, with the mouth of the can open, and covering the rim while seated thereon. The opening 68 defined by the collar portion 66 substantially registers with the inner periphery of the paint can rim 40 when seated thereon, such periphery comprising the inner surface of the rim flange portion 42, which also defines the mouth of the paint can 30.

A sealing ring 70 depends from the collar portion 66 of the shelf 60 around the inner margin of the collar portion adjacent to the opening 68 defined thereby. In the illustrative preferred embodiment, the sealing ring 70 is formed integrally in one piece with the shelf 60 and the collar portion 66 thereof. The sealing ring 70 has a frusto-conical configuration, and it tapers slightly inwardly from the collar portion 66. The sealing ring 70 is constructed and arranged or adapted for being received telescopically within the paint can rim 40 with the mouth of the can open, and the collar portion 66 seated on the rim, in a friction fit between the ring 70 and the inner periphery of the paint can rim as formed by the flange portion 42, to prevent flow of paint between the sealing ring 70 and the rim 40.

The paint can support comprising the shelf 60 in the preferred illustrative embodiment and the integral sealing ring 70 are constructed integrally in one piece of molded plastic, such as Fiberglas-reinforced molded plastic. Referring to FIGS. 2, 3, 6 and 7, the shelf 60 comprises a flat planar upper surface layer 72 integral with the collar portion 66 therearound, and an integral depending reinforcing structure comprising crisscrossed ribs 74 depending therefrom and extending to depending parallel side walls 76 and 78 joined together by respective depending front and rear walls 80 and 82.

Figure 7:
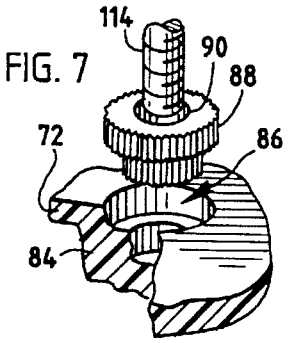
FIG. 7 is a still further enlarged exploded fragmentary perspective view of part of the clamping means shown in FIG. 6.

Referring to FIGS. 3, 6 and 7, localized integral depending reinforcements 84 are provided, and countersunk cylindrical recesses 86 in the surface layer 72 extend into the reinforcements 84. The recesses 86 receive similarly shaped, grooved bearings or plugs 88 each having a central blind bore or recess 90. The bearings 88 are received in the recesses 86 in tight frictional engagement therein, for a purpose subsequently described.

Figure 5:
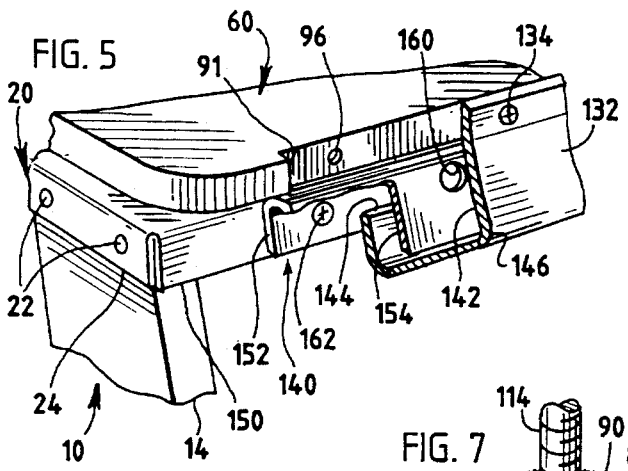
FIG. 5 is a further enlarged fragmentary top and front perspective view of the structure shown in FIG. 4, with parts of the support-mounting means broken away.
Figure 9:
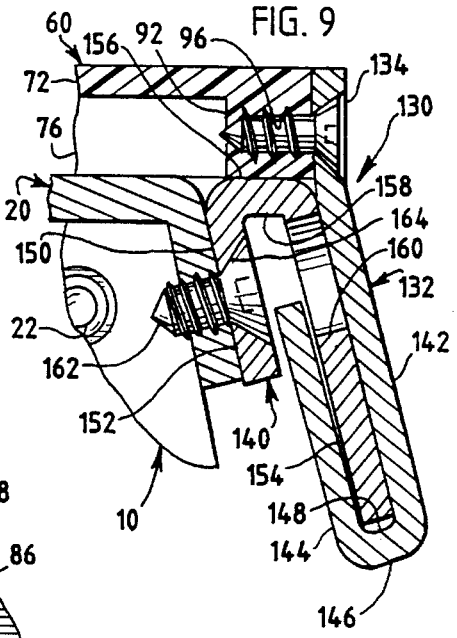
FIG. 9 is a further enlarged fragmentary vertical sectional view of the support-mounting means, similar to FIG 4, but enlarged with respect thereto, taken substantially on line 9—9 of FIG. 2.

Referring to FIGS. 3, 5 and 9, in particular, a rectangular recess 91 is formed along the front margin of the shelf 60, and three transversely spaced apart block-shaped reinforcements 92 are molded integrally with the front wall 80. Each reinforcement 92 is provided with a tapped hole 96 for a purpose subsequently described.

Referring to FIGS. 2 and 3, the shelf 60 is further provided with a depending integral slotted reinforcement 98 adapted for receiving a putty knife or the like inserted in a corresponding slot 99 in the surface layer 72. Depending integral cylindrically tubular reinforcements 100 and 102 in the shelf 60 receive other tools, such as screwdrivers, inserted in respective registering openings 104 and 106, in the surface layer 72. Such tools are illustrated in phantom lines in FIG. 2, wherein a putty knife or the like 99*a* is shown inserted in the slot 99, and a screwdriver 104*a* is shown inserted in the opening 104.

The paint can holder 12 includes clamping means in the form of a plurality of "C-clamp" type clamps 110, for detachably connecting the paint can 30 to the supporting shelf 12 for suspending the paint can from the shelf with the collar portion 66 seated on the rim 40 and the sealing ring 70 received within the rim in the above-described friction fit. The clamps 110 and their mounting are shown in detail in FIG. 6, and they are also visible in FIGS. 1, 2 and 4. In the illustrative preferred embodiment, two clamps 110 are provided, and they are disposed in diametrically opposed relation approximately along the longitudinal axis of the shelf 60.

Each clamp 110 is composed of a generally C-shaped plate connector 112 and a thumbscrew 114. The connector 112 includes an upper or outer arm 116 having a tapped hole 118 therethrough, a leg 120 integral therewith and depending therefrom, and a hooking portion or hook 122 integral with the leg 120 and formed by a reverse bend at the lower end of the leg. The hooking portion 122 preferably is inserted between the rim 40, radially outwardly of the grooved portion 44 thereof, and the body 34 of the can 30, for hooking onto the rim of 40 in the process of clamping. The thumbscrew 114 is threaded through the tapped hole 118 in the arm 116, and enters the bore or recess 90 in the bearing 88, which is affixed in the recess 86 in the upper surface layer 72 of the shelf 60. Tightening the thumbscrew by threading it inwardly or downwardly serves to clamp the paint can rim 40 to the shelf 60 supporting the paint can.

With both clamps 110 secured in the foregoing manner, the paint can 30 is detachably connected to the shelf 60 for suspending the can from the shelf with the collar portion seated or abutting on the rim 40, and the sealing ring 70 received within the rim 40 in a friction fit. The upper end of the can body 34 and the rim 40 thereat are covered and shielded from paint 124 (see FIG. 4) loaded in the can 30, keeping the rim groove free of paint and preventing paint from overflowing the rim onto the outside of the paint can body 34.

When painting with the assembled holder 12 and can 30, a paintbrush is dipped into the paint 124, and excess paint is removed from the brush by scraping against the inner edge of the collar 66 at the top of the sealing ring 70. The paint removed in this manner, and any paint flowing onto the collar 66, flows down the sealing ring 70 into the can 30, without ever reaching the topside of the rim 40. In the illustrative embodiment, employing a one-gallon can of paint, the diameter of the shelf opening 68 is approximately 5⅜ inches, which easily receives the popular three and one-half or four-inch square or angular brush used for "cutting in." The device may be appropriately sized for other paint can sizes.

Referring particularly to FIGS. 2–5 and 9, the holder 12 includes means generally indicated at 130 for mounting the support comprising the shelf 60 on the ladder 10. Such means includes the structure defining the recess 91 and the tapped holes 96 along the front end of the shelf 60, and a generally J-shaped, in cross section, slide means in the form of an elongate bracket 132. The upper end or rim of the bracket 132 is received in the shelf end recess 91 and secured to the shelf by screws 134 inserted through corresponding holes in the bracket rim and threaded into the tapped holes 96 in the shelf 60. The bracket projects downwardly and is inclined outwardly, for receiving freely in interlocking engagement complementary slide means in the form of an elongate bracket 140 on the ladder 10.

For providing the interlocking slidable interengagement, the bracket 132 on the shelf 60 is formed to provide outer and inner legs 142 and 144, respectively, joined together by a reverse bend 146 forming an upwardly opening channel 148 between the legs.

The top piece 20 of the ladder 10 is formed with a depending front wall 150, which in this instance slopes downwardly and slightly outwardly. The bracket 140 providing slide means on the ladder is mounted on the front wall 150. The bracket 140 is formed as an inverted, in use, J-shaped structure having an inner leg 152 in spaced parallel relation to an outer and somewhat longer leg 154, joined together by a reverse bend 156 providing a downwardly facing channel 158 between the legs.

The outer leg 154 of the ladder bracket 140 is provided with several openings 160 large enough to insert a mounting screw 162 through each. The inner leg 152 of the ladder bracket 140 is provided with registering openings 164. The screws 162 are inserted through the registering openings 160 and 164, into threaded engagement with the front wall 150 of the top piece 20. The front wall 150 of the top piece may be provided with holes suitable for receiving the screws 162. The screws may be self-tapping. Alternatively, screws having outer drill bit ends, followed by self-tapping sections, may be supplied for mounting the ladder bracket 140 on ladders having top pieces of other construction, for attachment to the top pieces. Thus, a combination of the paint can holder 12 and a ladder bracket 140, along with suitable screws 162, may be supplied for use on various stepladders.

The front portion 62 of the shelf 60 is adapted to be mounted on the top piece 20 of the stepladder 10, and the rear end portion 64 is adapted to project rearwardly beyond the back of the ladder when mounted, to support the paint can 30 spaced backwardly from the ladder. The slide means including the brackets 132 and 140 are designed for mounting the paint can holder 12 from either side of the ladder 10, while maintaining the holder shelf 60 in its normally generally horizontal position supporting a loaded paint can 30, without excessive tipping and/or splashing.

Thus, the holder 12 may be assembled with the can 30 on the ground or other suitable surface, then elevated to a height suitable for mounting on the top piece 20. The brackets 132 and 140 then are interengaged, and the assembly is slid transversely into place on the top piece 20. In the process, the outer leg 154 of the ladder bracket 140 is received in the channel 148 between the shelf bracket legs 142 and 144, while the inner shelf bracket leg 144 is received in the channel 158 between the ladder bracket legs 152 and 154, all in free sliding interengagement serving to interlock the brackets and secure the holder 12 and paint can 30 firmly in position on top of the stepladder. The holder and paint can are removed simply by oppositely directed sliding translational movement thereof relative to the ladder and slide means thereon, to either side of the ladder. It will be noted that the paint can 30 clears the ladder, in back of the back legs 16 as the holder 12 straddles the top piece 20 in mounting and dismounting the holder.

The assembly of the paint can holder 12 and the paint can 30 also may be used for painting when not mounted on a ladder, in the condition illustrated in FIG. 2. Thus, it may be set upon the ground or other supporting surface or carried by the painter while painting. Care then must be taken not to tip over the assembly and spill the paint, but there is a continued advantage in keeping the rim 40 and the outer surface of the paint can body 34 covered and protected from overflowing paint and paintbrush scrapings. The assembly is readily remounted on a ladder when painting at higher elevations is resumed. It should be noted that when the assembly is mounted on the ladder 10, the ladder can be moved from place to place with the assembly securely supported on the top of the ladder, with minimum danger of spillage. When painters move a ladder having a paint can hooked onto a rung, as described hereinabove, the can may sway and move about, causing paint spillage.

The invention thus provides a paint can holder well suited for suspending a paint can while mounted on a ladder, securely and conveniently accessible. The holder supports the paint can without danger of spilling the paint, enabling the painter to work with a brush directly from an open can of paint. A paint can is easily and rapidly assembled with the holder, and disassembled when use is ended or when it is desired to change cans. Cleanup following painting is a simple matter, with the lid of the can restored immediately to its original seal with the rim of the can, and without paint in the rim groove to interfere with proper sealing or make the lid difficult to remove. The holder is easy to use by both non-professionals and professionals.

While a preferred embodiment of the invention has been illustrated and described, it will be apparent to those skilled in the art that various changes and modifications may be made therein within the spirit and scope of the invention. It is intended that all such changes and modifications be included within the scope of the claims.

I claim:

1. A paint can holder adapted for suspending a paint can with the mouth of the can open to enable painting directly from the can, said can having a sealing rim around its mouth, which comprises;

a paint can support adapted to be mounted on a ladder, means for mounting said support on a ladder, said support including a collar portion adapted for seating on said sealing rim with the mouth of the can open and covering the rim while seated thereon, said collar portion defining an opening substantially registering with the inner periphery of said paint can rim when seated thereon, a sealing ring depending from said collar portion adjacent to said opening defined thereby and adapted for being received telescopically within said paint can rim with the mouth of the can open when the collar portion is seated on the rim, in a friction fit between the sealing ring and said inner periphery of the paint can rim, to prevent flow of paint therebetween, and means for detachably connecting said paint can to said support for suspending the paint can from the support with said collar portion seated on said rim and said sealing ring received within said rim in said friction fit.

2. A paint can holder as defined in claim 1 wherein said support-mounting means comprises means on said support for interlocking engagement with complementary means on a ladder upon relative translational movement of the support from a side of the ladder towards the ladder transversely with respect to the ladder, and for disengaging said means on said support and said means on said ladder upon transverse relative translational movement of the support away from the ladder to a side of the ladder.

3. A paint can holder as defined in claim 2 wherein said means on said support and said means on said ladder are adapted for sliding translational movement relative to each other.

4. A paint can holder as defined in claim 1 wherein said connecting means comprises means for clamping said paint can rim to said support.

5. A paint can holder as defined in claim 2 wherein said connecting means comprises means for clamping said paint can rim to said support.

6. A paint can holder adapted for suspending a paint can with the mouth of the can open to enable painting directly from the can, said can having a sealing rim around its mouth, which comprises;

a shelf having a front end portion adapted to be mounted on the top piece of a stepladder and a rear end portion adapted to project rearwardly beyond the back of the ladder when mounted, slide means mounted on said front end portion of said shelf and adapted for interlocking engagement with complementary slide means on said top piece of a stepladder, said slide means on said shelf being adapted for sliding translational movement thereof relative to said slide means on said top piece for mounting said shelf on said top piece by relative translational movement of the shelf from a side of the ladder towards the ladder transversely with respect to the ladder, and for removing said shelf from said top piece by transverse relative translational movement of the shelf away from the ladder to a side of the ladder, said rear end portion of said shelf being adapted for seating on said sealing rim of said paint can with the mouth of the can open and covering the rim while seated thereon, said rear end portion defining an opening substantially registering with the inner periphery of said paint can rim when seated thereon, a sealing ring depending from said rear end portion adjacent to said opening defined thereby and adapted for being received telescopically within said paint can rim with the mouth of the can open when the rear end portion is seated on the rim, in a friction fit between the sealing ring and said inner periphery of the paint can rim to prevent flow of paint therebetween, and a plurality of clamps for detachably clamping said paint can rim to said rear end portion for suspending the paint can from said support with said rear end portion seated on said rim and said sealing ring received within said rim in said friction fit.

7. A paint can holder as defined in claim 6 in combination with slide means complementary to said slide means mounted on said front end portion of said shelf and adapted for interlocking engagement therewith, and means for mounting said complementary slide means on the top piece of a stepladder.

8. In a paint can holder adapted for suspending a paint can with the mouth of the can open to enable painting directly from the can, said can having a sealing rim around its mouth, the combination which comprises;

a paint can support including a collar portion adapted for seating on said sealing rim with the mouth of the can open and covering the rim while seated thereon, said collar portion defining an opening substantially registering with the inner periphery of said paint can rim when seated thereon, a sealing ring depending from said collar portion adjacent to said opening defined thereby and adapted for being received telescopically within said paint can rim with the mouth of the can open when the collar portion is seated on the rim, in a friction fit between the sealing ring and said inner periphery of the paint can rim, to prevent flow of paint therebetween, and means for detachably connecting said paint can to said support for suspending the paint can from the support with said collar portion seated on said rim and said sealing ring received within said rim in said friction fit.

9. A paint can holder as defined in claim 8 wherein said connecting means comprises means for clamping said paint can rim to said support.

10. A paint can holder as defined in claim 9 wherein said clamping means comprises a plurality of "C-clamp" type clamps.

* * * * *